US012753622B2

(12) United States Patent
Kuroiwa et al.

(10) Patent No.: US 12,753,622 B2
(45) Date of Patent: Oct. 6, 2026

(54) BUCKLING-RESTRAINED BRACE AND METHOD FOR MOUNTING BUCKLING-RESTRAINED BRACE

(71) Applicant: NIPPON STEEL ENGINEERING CO., LTD., Tokyo (JP)

(72) Inventors: Toyoki Kuroiwa, Tokyo (JP); Benjamin Jacob Sitler, Tokyo (JP); Masao Terashima, Tokyo (JP)

(73) Assignee: NIPPON STEEL ENGINEERING CO., LTD., Tokyo (JP)

( * ) Notice: Subject to any disclaimer, the term of this patent is extended or adjusted under 35 U.S.C. 154(b) by 432 days.

(21) Appl. No.: 18/556,494

(22) PCT Filed: Apr. 25, 2023

(86) PCT No.: PCT/JP2023/016321

§ 371 (c)(1),
(2) Date: Oct. 20, 2023

(87) PCT Pub. No.: WO2023/233876

PCT Pub. Date: Dec. 7, 2023

(65) Prior Publication Data

US 2025/0084659 A1 Mar. 13, 2025

(30) Foreign Application Priority Data

May 31, 2022 (JP) ..... 2022-089013

(51) Int. Cl.
*E04H 9/02* (2006.01)

(52) U.S. Cl.
CPC ..... *E04H 9/02* (2013.01)

(58) Field of Classification Search
CPC ..... E04H 9/0237; E04H 9/02
See application file for complete search history.

(56) References Cited

U.S. PATENT DOCUMENTS

2003/0221389 A1* 12/2003 Smelser ..... E04C 3/02 52/853
2004/0107654 A1* 6/2004 Powell ..... E04H 9/0237 52/167.3

(Continued)

FOREIGN PATENT DOCUMENTS

CN 108222286 A * 6/2018 ..... E04B 1/58
CN 111155819 A * 5/2020 ..... E04H 9/021

(Continued)

OTHER PUBLICATIONS

International Search Report for PCT/JP2023/016321, mailed on Jun. 13, 2023.

(Continued)

*Primary Examiner* — Babajide A Demuren
(74) *Attorney, Agent, or Firm* — Rabin & Berdo, P.C.

(57) ABSTRACT

A buckling-restrained brace includes a core, a restrainer encasing the core from an outer side thereof, a stiffening member joined to the core in a state where a part of the stiffening member is disposed inside the restrainer, and a connector having a first end portion that is pin-joined to the structure and a second end portion that is joined to at least one of the core and the stiffening member, in which an elongated hole is provided in at least one of the core, the stiffening member, and the connector as a position adjustment mechanism configured to adjust a relative position between the connector and at least one of the core and the stiffening member.

13 Claims, 9 Drawing Sheets

(56) References Cited

U.S. PATENT DOCUMENTS

| | | | | |
|---|---|---|---|---|
| 2008/0250732 | A1* | 10/2008 | Tsai | E04H 9/0237 52/167.3 |
| 2008/0289267 | A1* | 11/2008 | Sarkisian | E04H 9/0237 52/167.3 |
| 2010/0005737 | A1* | 1/2010 | Tsai | E04H 9/0237 52/167.3 |
| 2023/0038362 | A1* | 2/2023 | Chou | E04H 9/02 |

FOREIGN PATENT DOCUMENTS

| | | | | | |
|---|---|---|---|---|---|
| CN | 113982135 | A | * | 1/2022 | E04H 9/021 |
| CN | 114991558 | A | * | 9/2022 | E04H 9/021 |
| CN | 118128180 | A | * | 6/2024 | E04G 21/14 |
| JP | H05311765 | A | | 11/1993 | |
| JP | 2000248775 | A | * | 9/2000 | |
| JP | 2002235380 | A | | 8/2002 | |
| JP | 2004232292 | A | | 8/2004 | |
| JP | 2007016447 | A | | 1/2007 | |
| JP | 2007291704 | A | * | 11/2007 | |
| JP | 2012026123 | A | | 2/2012 | |
| JP | 6167253 | B1 | * | 7/2017 | |
| JP | 2018119309 | A | | 8/2018 | |
| JP | 6544546 | B1 | | 7/2019 | |
| KR | 20170014542 | A | * | 2/2017 | E04B 1/30 |
| TW | M554926 | U | | 2/2018 | |

OTHER PUBLICATIONS

Office Action for JP 2023-024266, mailed on May 9, 2023.
Taiwanese Office Action dated Oct. 4, 2023, in the counterpart Taiwanese patent application No. 112115798.

* cited by examiner

BUCKLING-RESTRAINED BRACE AND METHOD FOR MOUNTING BUCKLING-RESTRAINED BRACE

TECHNICAL FIELD

The present invention relates to a buckling-restrained brace and a method for mounting a buckling-restrained brace.

Priority is claimed on Japanese Patent Application No. 2022-089013, filed in Japan on May 31, 2022, the content of which is incorporated herein by reference.

BACKGROUND ART

Conventionally, a buckling-restrained brace has been used as a reinforcing member for a structure. In the buckling-restrained brace, a core that receives an axial force is restrained by a restrainer or the like from an outer side thereof such that the core is plastically deformed while preventing non-axial deformation and buckling. The buckling-restrained brace is used to improve the seismic resistance and damping performance of the structure.

In a buckling-restrained brace of Patent Document 1, in order to adjust the length of the buckling-restrained brace, a male screw is formed on a core, and a female screw portion into which the male screw is screwed is formed on a connector for joining the core to the structure.

CITATION LIST

Patent Document

[Patent Document 1] Japanese Patent No. 6544546

SUMMARY OF INVENTION

Technical Problem

To improve designability, it is considered that the buckling-restrained brace is pin-joined to the structure. Due to manufacturing errors of the buckling-restrained brace or construction errors of the structure, it may be difficult to insert a pin through a pin hole formed in the buckling-restrained brace or a through-hole formed in the structure.

In addition, when the structure is constructed, an initial axial force is introduced into the buckling-restrained brace mounted on the structure due to the dead weight of the structure, contraction of members of the structure due to a load applied to the structure during construction, or the like. As a result, the seismic resistance and damping performance of the buckling-restrained brace may be deteriorated. With the structure of Patent Document 1, it is difficult to release the initial axial force introduced into the buckling-restrained brace.

The present invention has been made in view of the circumstances described above, and an object of the present invention is to provide a buckling-restrained brace and a method for mounting a buckling-restrained brace, which can be easily mounted on a structure and can prevent deterioration in the seismic resistance and damping performance of the buckling-restrained brace.

Solution to Problem

According to a first aspect of the present invention, a buckling-restrained brace is to be mounted on a structure, and includes a core, a restrainer encasing the core from an outer side thereof, a stiffening member joined to the core in a state where a part of the stiffening member is disposed inside the restrainer, and a connector having a first end portion that is pin-joined to the structure and a second end portion that is joined to at least one of the core and the stiffening member, in which an elongated hole is provided in at least one of the core, the stiffening member, and the connector as a position adjustment mechanism configured to adjust a relative position between the connector and at least one of the core and the stiffening member.

Since the relative position between the connector and at least one of the core and the stiffening member can be adjusted using the position adjustment mechanism, it is possible to easily mount the buckling-restrained brace on the structure. In addition, as the construction of the structure progresses, an initial axial force is introduced into the buckling-restrained brace mounted on the structure due to the dead weight of the structure, contraction of members of the structure due to a load applied to the structure during construction, or the like. The relative position between the connector and at least one of the core and the stiffening member can be adjusted using the position adjustment mechanism such that it is possible to release the axial force applied from the structure to the buckling-restrained brace. Therefore, it is possible to prevent deterioration of the seismic resistance and damping performance of the buckling-restrained brace.

In addition, since the elongated hole is provided as the position adjustment mechanism, it is possible to easily adjust the relative position between the connector and at least one of the core and the stiffening member with a simple configuration.

According to a second aspect of the present invention, in the buckling-restrained brace according to the first aspect, the elongated hole is provided in the connector.

According to a third aspect of the present invention, in the buckling-restrained brace according to the first aspect or the second aspect, the elongated hole is provided in the core or the stiffening member.

According to a fourth aspect of the present invention, in the buckling-restrained brace according to any one of the first aspect to the third aspect, as the connector, a pair of connectors are provided, and the core or the stiffening member is sandwiched between the pair of connectors.

According to a fifth aspect of the present invention, in the buckling-restrained brace according to any one of the first aspect to the fourth aspect, as the stiffening member, a pair of stiffening members are provided to be spaced apart from each other in a width direction of the core.

According to a sixth aspect of the present invention, the buckling-restrained brace according to the fifth aspect further includes a first plate provided between the pair of stiffening members.

According to a seventh aspect of the present invention, in the buckling-restrained brace according to any one of the first aspect to the sixth aspect, as the core, a pair of cores are provided to be spaced apart from each other in a thickness direction of the core.

According to an eighth aspect of the present invention, the buckling-restrained brace according to the seventh aspect further includes a second plate provided between the pair of cores.

According to a ninth aspect of the present invention, in the buckling-restrained brace according to any one of the first aspect to the eighth aspect, as the stiffening member, a pair of second cores are provided, and the core is sandwiched between the pair of second cores in a thickness direction of the core.

According to a tenth aspect of the present invention, in the buckling-restrained brace according to any one of the first aspect to the ninth aspect, the restrainer has a tubular shape, an inside of the restrainer is filled with an infill material, and the elongated hole is provided outside the restrainer.

According to an eleventh aspect of the present invention, a method for mounting a buckling-restrained brace, in which the buckling-restrained brace according to any one of the first aspect to the tenth aspect is mounted on the structure, includes a position adjusting step of temporarily determining a position of the connector by adjusting a relative position between the connector and at least one of the core and the stiffening member using the position adjustment mechanism, an axial force releasing step of releasing an axial force applied from the structure to the buckling-restrained brace by releasing the temporary determination of the position of the connector using the position adjustment mechanism, and a final joining step of finally joining the connector to at least one of the core and the stiffening member, the final joining step being performed after the axial force releasing step.

Since the axial force applied from the structure to the buckling-restrained brace is released in the axial force releasing step, it is possible to prevent deterioration of the seismic resistance and damping performance of the buckling-restrained brace.

According to a twelfth aspect of the present invention, the method for mounting the buckling-restrained brace according to the eleventh aspect further includes a pin joining step of pin-joining the connector to the structure, the pin joining step being performed before the position adjusting step.

According to a thirteenth aspect of the present invention, a method for mounting a buckling-restrained brace, in which the buckling-restrained brace according to any one of the first aspect to the tenth aspect is mounted on the structure, includes a pin joining step of pin-joining the connector to the structure, and a final joining step of finally joining the connector to at least one of the core and the stiffening member, in which after the pin joining step and before the final joining step, an axial force, which is applied from the structure during construction to the buckling-restrained brace, is relieved by adjusting a relative position between the connector and at least one of the core and the stiffening member to freely move in an axial direction of the buckling-restrained brace using the position adjustment mechanism.

Since after the pin joining step and before the final joining step, the axial force, which is applied from the structure during construction to the buckling-restrained brace, can be relieved, it is possible to prevent deterioration of the seismic resistance and damping performance of the buckling-restrained brace.

Advantageous Effects of Invention

According to the present invention, it is possible to provide a buckling-restrained brace, which can be easily mounted on a structure and can prevent deterioration in the seismic resistance and damping performance of the buckling-restrained brace, and a method for mounting the buckling-restrained brace.

DESCRIPTION OF EMBODIMENTS

First Embodiment

Hereinafter, a buckling-restrained brace 10 according to a first embodiment of the present invention will be described with reference to FIGS. 1 to 4.

Figure 1:
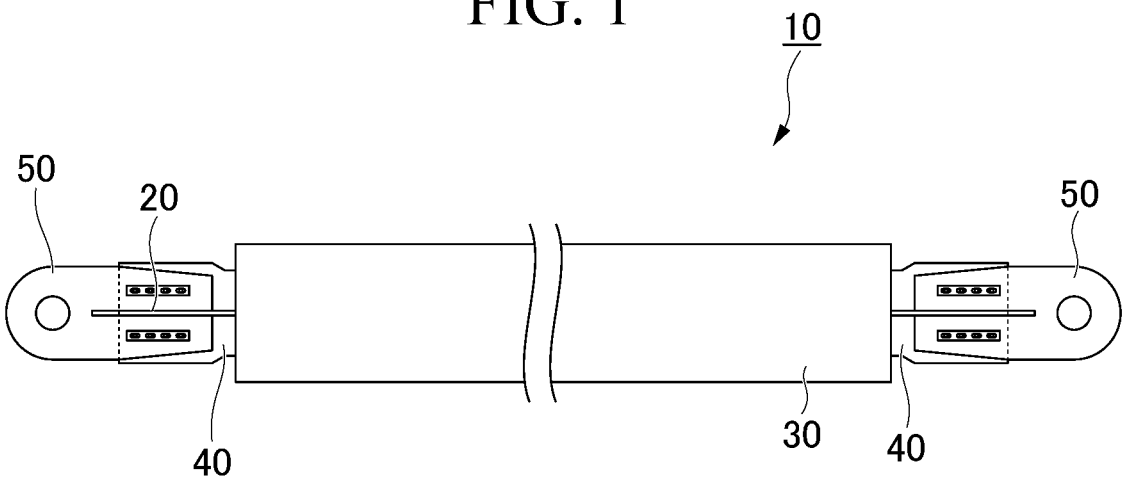
FIG. 1 is a side view of a buckling-restrained brace according to a first embodiment of the present invention.
Figure 2A:
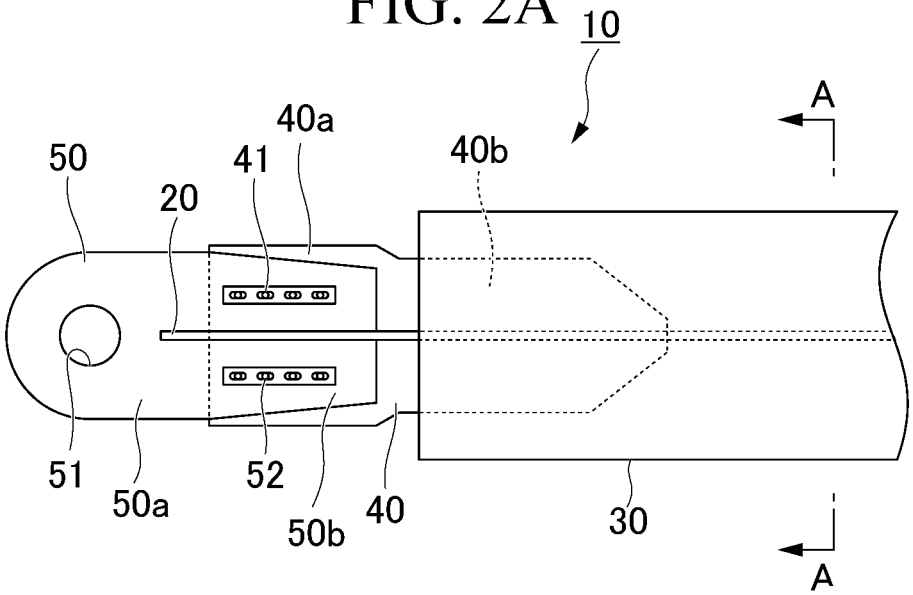
FIG. 2A is a side view showing one end portion of the buckling-restrained brace according to the first embodiment of the present invention.
Figure 2B:
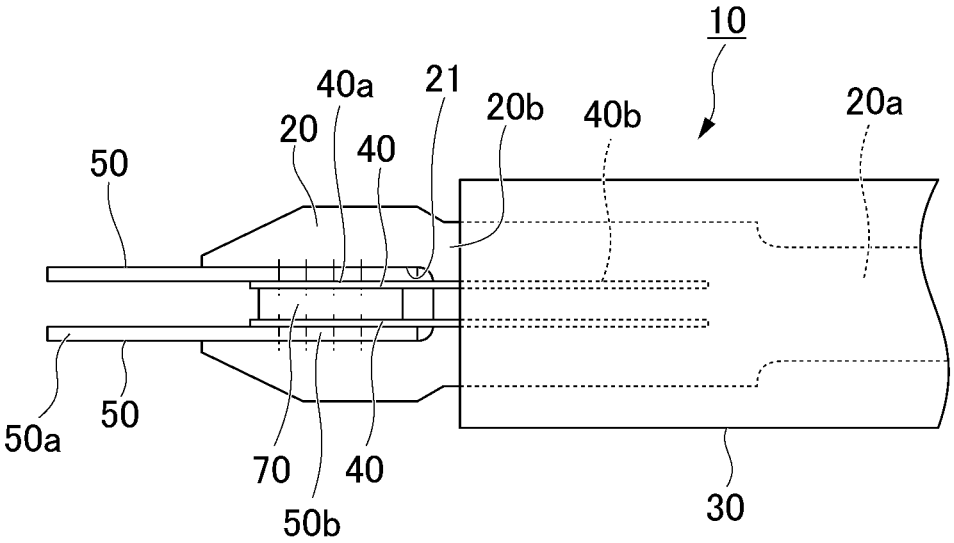
FIG. 2B is a plan view showing one end portion of the buckling-restrained brace according to the first embodiment of the present invention.
Figure 2C:
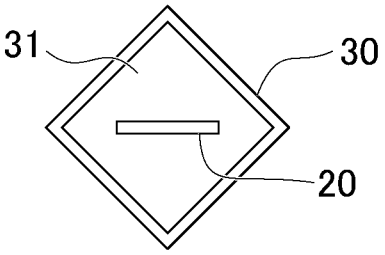
FIG. 2C is a sectional view taken along line A-A of FIG. 2A.

FIG. 1 is a side view of the buckling-restrained brace 10. FIG. 2A is a side view showing one end portion of the buckling-restrained brace 10, FIG. 2B is a plan view showing one end portion of the buckling-restrained brace 10, and FIG. 2C is a sectional view taken along line A-A of FIG. 2A. Hereinafter, a direction along an axis of the buckling-restrained brace 10 is referred to as an axial direction. In addition, a central side of the buckling-restrained brace 10 along the axial direction is referred to as an inside in the axial direction, and an opposite side thereof is referred to as an outside in the axial direction.

The buckling-restrained brace 10 is used, for example, for a diagonal beam in a building or a bridge structure, and improves the seismic resistance and damping performance thereof.

As shown in FIGS. 1 and 2A to 2C, the buckling-restrained brace 10 includes a core 20, a restrainer 30, rib plates 40 (stiffening member), clevis plates 50 (connector), and first interposing plates 70 (first plate).

The core 20 has a plate shape extending in the axial direction. The core 20 is formed of a steel plate. Hereinafter, a thickness direction of the core 20 is simply referred to as a thickness direction. A width direction of the core 20 is simply referred to as a width direction.

As shown in FIG. 2B, the core 20 includes a small-width portion 20*a* and large-width portions 20*b*. The small-width portion 20*a* is located at a center of the core 20 in the axial direction. The large-width portions 20*b* are located at both ends of the core 20 in the axial direction. The width of the large-width portion 20*b* is larger than the width of the small-width portion 20*a*. The length of the large-width portion 20*b* in the axial direction is shorter than the length of the small-width portion 20*a* in the axial direction. Since the center of the core 20 in the axial direction is the small-width portion 20*a* and the end portions of the core 20 in the axial direction are the large-width portions 20*b*, the center of the core 20 in the axial direction (small-width portion 20*a*) is a region that is easily plasticized, and the plasticized region is limited to the center of the core 20 in the axial direction.

The large-width portion 20*b* is formed with a slit 21 extending from an end of the core 20 in the axial direction to an inside in the axial direction. The rib plate 40, the clevis plate 50, and the first interposing plate 70 are disposed in the slit 21.

The restrainer 30 has a tubular shape. For example, the restrainer 30 is a square tubular steel pipe. As shown in FIG. 2C, a cross-sectional shape of the restrainer 30 orthogonal to the axial direction is a square shape. The cross-sectional shape of the restrainer 30 may have a rectangular shape, a diamond shape, or the like. The restrainer 30 may be a cylindrical steel pipe.

The restrainer 30 extends in the axial direction. The restrainer 30 encases the core 20 from an outer side thereof. The length of the restrainer 30 in the axial direction is shorter than the length of the entire core 20 in the axial direction. The length of the restrainer 30 in the axial direction is longer than the length of the small-width portion 20*a* of the core 20 in the axial direction. The large-width portion 20*b* of the core 20 protrudes outward in the axial direction from the restrainer 30.

The inside of the restrainer 30 is filled with an infill material 31 such as concrete or mortar. The infill material 31 is filled between the core 20 and the restrainer 30. To prevent the infill material 31 from leaking out from end portions of the restrainer 30, both end openings of the restrainer 30 are blocked by lids (not shown). The infill material 31 supports the core 20 in a manner so that the axial force of the core 20 is not transmitted to the restrainer 30, that is, the core 20 can move relative to the restrainer 30 in the axial direction. The restrainer 30 and the infill material 31 restrict deformation of the core 20 in a direction other than the axial direction. To prevent the core 20 and the infill material 31 from adhering to each other, an adhesion prevention material (not shown) may be provided between the core 20 and the infill material 31.

The rib plate 40 has a plate shape extending in the axial direction. As shown in FIG. 2B, a pair of the rib plates 40 are provided at each end portion of the buckling-restrained brace 10. The rib plate 40 has a first end portion 40*a* that is disposed axially outward and a second end portion 40*b* that is disposed axially inward than the first end portion 40*a*.

The rib plate 40 is provided to extend inside and outside the restrainer 30. The second end portion 40*b* of the rib plate 40 is disposed inside the restrainer 30, and the first end portion 40*a* of the rib plate 40 is disposed outside the restrainer 30.

Figure 3:
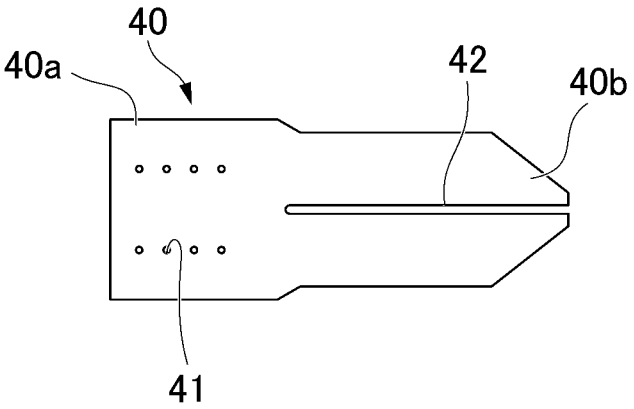
FIG. 3 is a plan view of a rib plate according to the first embodiment of the present invention.

FIG. 3 is a plan view of the rib plate 40. As shown in FIG. 3, a plurality of bolt holes 41 are formed in the first end portion 40*a* of the rib plate 40. The bolt hole 41 has a circular shape. A plurality of bolts 61 (see FIGS. 6A and 6B) are inserted through the plurality of bolt holes 41.

A slit 42 is formed in the second end portion 40*b* of the rib plate 40 so as to extend axially outward from an end of the rib plate 40 on an inside in the axial direction. A portion of the large-width portion 20*b* of the core 20, which is located inside the slit 21 in the axial direction, is inserted into the slit 42. In this case, as shown in FIG. 2B, the first end portion 40*a* of the rib plate 40 is disposed in the slit 21.

The rib plate 40 intersects perpendicularly with the core 20. An angle of the rib plate 40 with respect to the core 20 may not be perpendicular. The rib plate 40 is fixed to the core 20. Specifically, the second end portion 40*b* of the rib plate 40 is joined to the large-width portion 20*b* by welding in a state where the large-width portion 20*b* of the core 20 is inserted into the slit 42. Since the second end portion 40*b* supports the large-width portion 20*b* from both sides thereof in the thickness direction, a buckling strength of the core 20 is improved.

The pair of rib plates 40 are disposed while being spaced apart from each other in the width direction. The first interposing plate 70 is provided between the pair of rib plates 40. The first interposing plate 70 is fixed to the rib plate 40. For example, the first interposing plate 70 is joined to the first end portion 40*a* of the rib plate 40 by welding. The rib plate 40 can be reinforced by filling a gap between the pair of rib plates 40 with the first interposing plate 70. Instead of the pair of rib plates 40 and the first interposing plate 70, a single rib plate 40, which has the same thickness as the size of a gap between a pair of clevis plates 50, may be provided.

The clevis plate 50 has a plate shape extending in the axial direction. As shown in FIG. 2B, a pair of the clevis plates 50 are provided at each end portion of the buckling-restrained brace 10.

The clevis plate 50 has a first end portion 50*a* that is disposed axially outward and a second end portion 50*b* that is disposed axially inward than the first end portion 50*a*.

The pair of clevis plates 50 are disposed while being spaced apart from each other in the width direction. The pair of rib plates 40 are disposed in the gap between the pair of clevis plates 50. That is, the pair of rib plates 40 are sandwiched between the pair of clevis plates 50 in the width direction of the core 20.

The clevis plate 50 is disposed outside the restrainer 30. The second end portion 50*b* of the clevis plate 50 faces the first end portion 40*a* of the rib plate 40 in the width direction of the core 20. The first end portion 50*a* of the clevis plate 50 is disposed to protrude axially outward from the first end portion 40*a* of the rib plate 40.

The clevis plate 50 intersects perpendicularly with the core 20. An angle of the clevis plate 50 with respect to the core 20 may not be perpendicular. The second end portion 50*b* of the clevis plate 50 is disposed in the slit 21.

Figure 4:
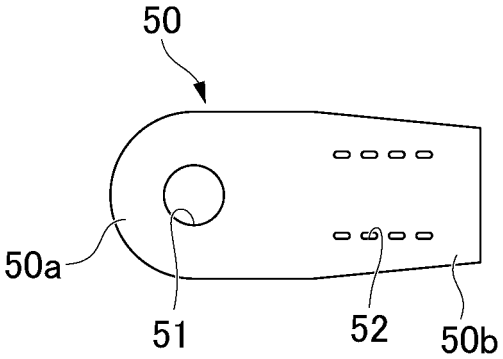
FIG. 4 is a plan view of a clevis plate according to the first embodiment of the present invention.

FIG. 4 is a plan view of the clevis plate 50. As shown in FIG. 4, a pin hole 51 is formed in the first end portion 50*a* of the clevis plate 50. The pin hole 51 has a circular shape. A column-shaped pin 62 (see FIGS. 5, 6A, and 6B) is inserted through the pin hole 51. The pin 62 is bridged between the pair of clevis plates 50.

A plurality of elongated holes 52 extending in the axial direction are formed in the second end portion 50*b* of the clevis plate 50. The plurality of elongated holes 52 are provided corresponding to the plurality of bolt holes 41. The plurality of bolts 61 are inserted through the plurality of elongated holes 52. The length of the elongated hole 52 in a long axis direction (that is, the length of the elongated hole 52 in the axial direction of the buckling-restrained brace 10) is longer than an outer diameter of an axis portion of the bolt 61 that is inserted through the elongated hole 52 by 3 mm or more. For example, the length of the elongated hole 52 in the long axis direction is about 20 mm longer than the outer diameter of the axis portion of the bolt 61. The length of the elongated hole 52 in a short axis direction is slightly longer than the outer diameter of the axis portion of the bolt 61. For example, a difference between the length of the elongated hole 52 in the short axis direction and the outer diameter of the axis portion of the bolt 61 is 2 to 3 mm.

By fastening the bolt 61 to the bolt hole 41 and the elongated hole 52, the second end portion 50*b* of the clevis plate 50 is joined to the rib plate 40. That is, the rib plate 40 and the clevis plate 50 are not firmly joined and are temporarily fixed through the bolt 61. When the bolt 61 is loosened, the clevis plate 50 can move in parallel with respect to the rib plate 40 in the axial direction, and the relative position between the rib plate 40 and the clevis plate 50 in the axial direction can be adjusted. That is, the bolt hole 41, the elongated hole 52, and the bolt 61 function as a position adjustment mechanism for adjusting the relative position between the rib plate 40 and the clevis plate 50 in the axial direction. Accordingly, the length of the entire buckling-restrained brace 10 in the axial direction can be adjusted. The position adjustment mechanism (that is, the bolt hole 41, the elongated hole 52, and the bolt 61) is provided outside the restrainer 30.

Figure 5:
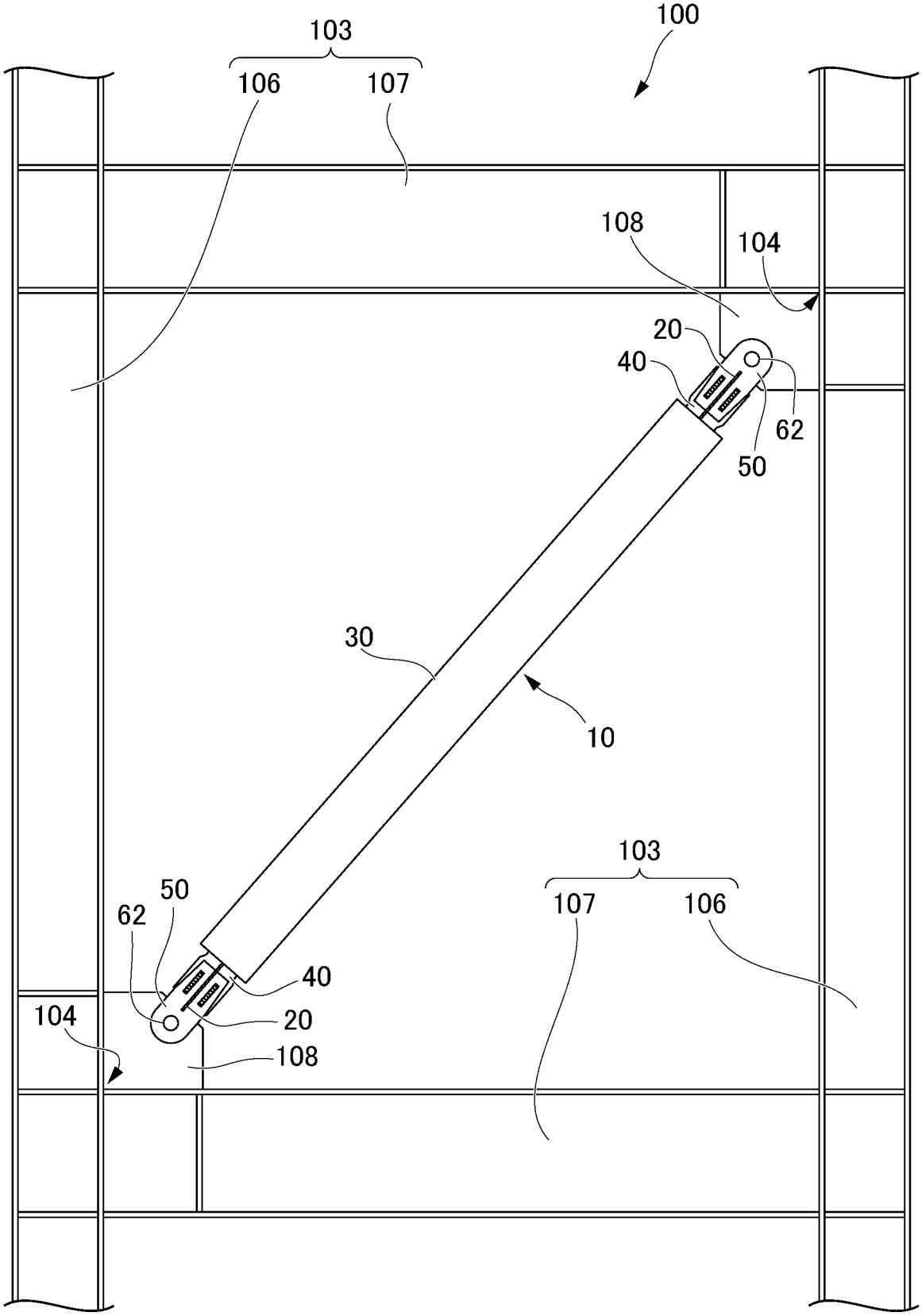
FIG. 5 is a view showing a structure in which the buckling-restrained brace according to the first embodiment of the present invention is installed.

Next, a structure 100 in which the buckling-restrained brace 10 is installed will be described with reference to FIG. 5.

The structure 100 includes a plurality of frames 103 each having a rectangular outer shape, and gusset plates 108 disposed on corner portions 104 of the frame 103. The buckling-restrained brace 10 is mounted on the frame 103 through the gusset plate 108.

The frame 103 has two vertical frames 106 (for example, steel pillars) extending in the vertical direction and spaced apart from each other in the horizontal direction, and two horizontal frames 107 (for example, steel beams) one of which connects upper ends of the vertical frames 106 to each other and the other of which connects lower ends of the vertical frames 106 to each other, and accordingly, the corner portions 104 are formed at connecting portions between the vertical frames 106 and the horizontal frames 107.

The gusset plates 108 are flat plate members and are disposed at the corner portions 104 of the frame 103. Specifically, the gusset plate 108 is provided between the vertical frame 106 and the horizontal frame 107 and projects obliquely upward or obliquely downward toward the inside of the frame 103. The gusset plate 108 is joined to the vertical frame 106 and the horizontal frame 107 by welding, for example.

A through-hole (not shown) through which the pin 62 is inserted is formed in the gusset plate 108. The gusset plate 108 is inserted between the first end portions 50*a* of the pair of clevis plates 50 provided at each of both end portions of the buckling-restrained brace 10. The pin 62 bridged between the clevis plates 50 is inserted through the through-hole of the gusset plate 108. Accordingly, the buckling-restrained brace 10 is pin-joined to the gusset plate 108. The pin-joining improves designability of the structure 100.

The buckling-restrained brace 10 is disposed so as to connect the diagonally-located two gusset plates 108 of the frame 103. The buckling-restrained brace 10 spans between the gusset plates 108. That is, the buckling-restrained brace 10 is provided such that its axis is inclined with respect to the vertical direction and the horizontal direction.

Next, a method for mounting the buckling-restrained brace 10 for mounting the buckling-restrained brace 10 on the structure 100 will be described. According to the present embodiment, the method for mounting the buckling-restrained brace 10 has a pin joining step, a position adjusting step, an axial force releasing step, and a final joining step. The pin joining step, the position adjusting step, and construction of the structure 100 are performed in parallel. The construction of the structure 100 includes, for example, an assembly work of the plurality of frames 103 and a mounting work of the gusset plate 108 on the frame 103. The gusset plate 108 may be welded and joined to the vertical frame 106 (steel pillar) or the horizontal frame 107 (steel beam) of the frame 103 in a steel processing factory.

Prior to the pin joining step, the buckling-restrained brace 10 manufactured at the factory is transported to a construction site of the structure 100. In this case, the clevis plate 50 is temporarily fixed to the rib plate 40 using the position adjustment mechanism. That is, the rib plate 40 and the clevis plate 50 are fixed to each other by fastening the bolt 61 to the bolt hole 41 and the elongated hole 52.

Figure 6A:
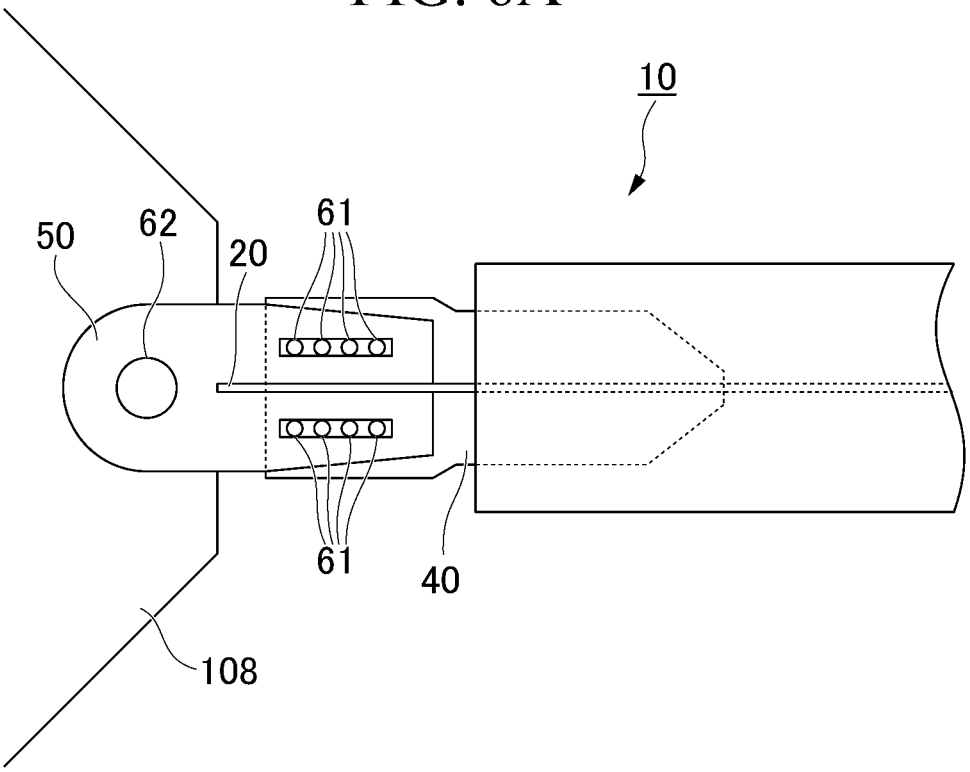
FIG. 6A is a view for explaining a method for mounting a buckling-restrained brace according to the first embodiment of the present invention.
Figure 6B:
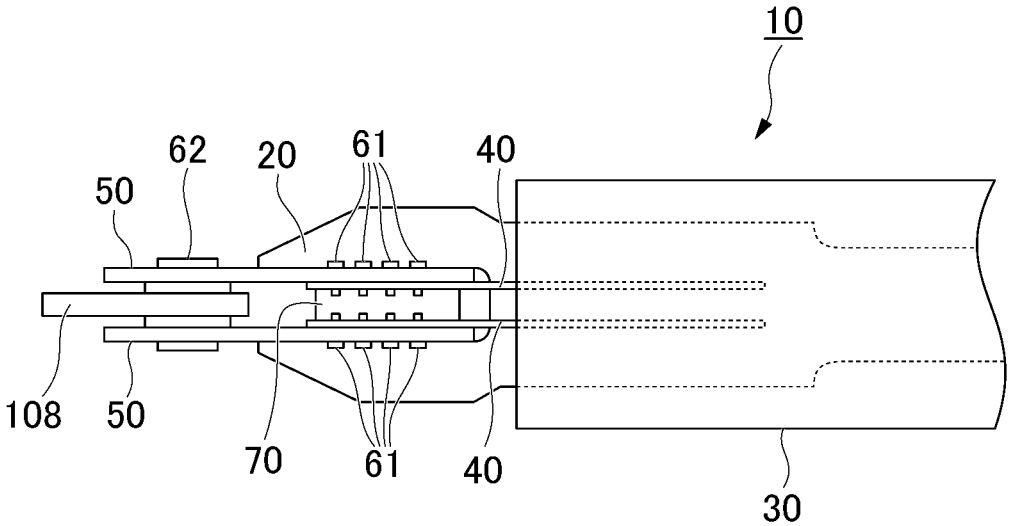
FIG. 6B is a view for explaining the method for mounting a buckling-restrained brace according to the first embodiment of the present invention.

As shown in FIGS. 6A and 6B, in the pin joining step, the gusset plate 108 is inserted between the first end portions 50*a* of the pair of clevis plates 50. The first end portion 50*a* of the clevis plate 50 is pin-joined to the gusset plate 108 by inserting the pin 62 through the pin hole 51 and the through-hole (not shown) formed in the gusset plate 108. In this case, generally, since the diameter of the pin hole 51 is only slightly larger (for example, about 1 mm) than the diameter of the pin 62, it may be difficult to insert the pin 62 through the pin hole 51 and the through-hole formed in the gusset plate 108 due to a manufacturing error of the buckling-restrained brace 10, a construction error of the structure 100 or the like. The relative position between the rib plate 40 and the clevis plate 50 in the axial direction is adjusted using the position adjustment mechanism such that the length of the entire buckling-restrained brace 10 in the axial direction can be adjusted. Accordingly, the position of the pin hole 51 can be aligned with the position of the through-hole formed in the gusset plate 108, and the pin 62 can be easily inserted through the pin hole 51 and the through-hole formed in the gusset plate 108.

In the position adjusting step, the position of the clevis plate 50 is temporarily determined by adjusting the relative position between the rib plate 40 and the clevis plate 50 in the axial direction using the position adjustment mechanism. Specifically, the bolt 61 is loosened, and the relative position of the clevis plate 50 with respect to the rib plate 40 is adjusted by moving the clevis plate 50 in parallel with respect to the rib plate 40 in the axial direction. Thereafter, the bolt 61 is fastened again to fix the rib plate 40 and the clevis plate 50 to each other, thereby temporarily determining the position of the clevis plate 50.

As the construction of the structure 100 progresses, an initial compressive axial force is introduced into the buckling-restrained brace 10 mounted on the structure 100 due to the dead weight of the structure 100, contraction of members (for example, vertical frame 106 or the like) of the structure 100 due to a load applied to the structure 100 during construction, or the like. In the axial force releasing step, by using the position adjustment mechanism (specifically, by loosening the bolt 61), the temporary determination of the position of the clevis plate 50 is released, and the clevis plate 50 is moved in parallel with respect to the rib plate 40 in the axial direction such that the initial compressive axial force, which is applied from the structure 100 to the buckling-restrained brace 10, is released. Thereafter, the bolt 61 is fastened again to fix the rib plate 40 and the clevis plate 50 to each other. The axial force releasing step may be performed, for example, after the construction of the structure 100 is completed. The axial force releasing step may be performed when the construction of the structure 100 has progressed to some extent.

In the final joining step, the clevis plate 50 is finally joined to the rib plate 40 by welding. The clevis plate 50 is finally joined to the core 20 by welding. Accordingly, the clevis plate 50 is firmly fixed to the rib plate 40 and the core 20. The clevis plate 50 may be joined to the rib plate 40 and the core 20 by a high-strength bolt or the like.

In the present embodiment, the buckling-restrained brace 10 includes the core 20, the restrainer 30 encasing the core 20 from an outer side thereof, the rib plate 40 joined to the core 20 in a state where a part of the rib plate 40 is disposed inside the restrainer 30, and the clevis plate 50 having the first end portion 50*a* that is pin-joined to the structure 100 and the second end portion 50*b* that is joined to the rib plate 40. The elongated hole 52 is provided in the clevis plate 50 as the position adjustment mechanism configured to adjust the relative position between the rib plate 40 and the clevis plate 50.

The method for mounting the buckling-restrained brace 10 includes the position adjusting step of temporarily determining the position of the clevis plate 50 by adjusting the relative position between the rib plate 40 and the clevis plate 50 using the position adjustment mechanism, the axial force releasing step of releasing the axial force applied from the structure 100 to the buckling-restrained brace 10 by releasing the temporary determination of the position of the clevis plate 50 using the position adjustment mechanism, and the final joining step of joining the clevis plate 50 to the rib plate 40, the final joining step being performed after the axial force releasing step.

Since the relative position between the rib plate 40 and the clevis plate 50 can be adjusted using the position adjustment mechanism, it is possible to easily mount the buckling-restrained brace 10 on the structure 100. In addition, as the construction of the structure 100 progresses, an initial axial force is introduced into the buckling-restrained brace 10 mounted on the structure 100 due to the dead weight of the structure 100, contraction of members of the structure 100 due to a load applied to the structure 100 during construction, or the like. The relative position between the rib plate 40 and the clevis plate 50 is adjusted using the position adjustment mechanism such that it is possible to release the axial force applied from the structure 100 to the buckling-restrained brace 10. Therefore, it is possible to prevent deterioration of the seismic resistance and damping performance of the buckling-restrained brace 10.

In addition, since the elongated hole 52 is provided as the position adjustment mechanism, it is possible to easily adjust the relative position between the rib plate 40 and the clevis plate 50 with a simple configuration.

Further, the buckling-restrained brace 10 has the pair of clevis plates 50, and the rib plate 40 is sandwiched between the pair of clevis plates 50.

Accordingly, it is possible to more reliably mount the buckling-restrained brace 10 on the structure 100, and it is possible to prevent deterioration of the seismic resistance and damping performance of the buckling-restrained brace 10.

Further, the buckling-restrained brace 10 has the pair of the rib plates 40 provided to be spaced apart from each other in the width direction of the core 20.

Accordingly, since it is possible to improve a buckling strength of the core 20, the seismic resistance and damping performance of the buckling-restrained brace 10 is further improved.

In addition, the buckling-restrained brace 10 further includes the first interposing plate 70 provided between the pair of rib plates 40.

Since the first interposing plate 70 can reinforce the pair of rib plates 40, the seismic resistance and damping performance of the buckling-restrained brace 10 is further improved.

Further, the restrainer 30 has a tubular shape, the inside of the restrainer 30 is filled with the infill material 31, and the elongated hole 52 is provided outside the restrainer 30.

Accordingly, the relative position between the rib plate 40 and the clevis plate 50 can be easily adjusted from the outside of the restrainer 30.

Second Embodiment

Next, a method for mounting the buckling-restrained brace 10 according to the second embodiment of the present invention will be described. In the present embodiment, the same components as those in the first embodiment are denoted by the same reference numerals, the description thereof will be omitted, and only the different parts will be described.

In the method for mounting the buckling-restrained brace 10 according to the present embodiment, the position adjusting step and the axial force releasing step are not performed. In the present embodiment, the method for mounting the buckling-restrained brace 10 has a pin joining step, an axial force relieving step, and a final joining step. The pin joining step, the axial force relieving step, and the construction of the structure 100 are performed in parallel.

In the pin joining step, the gusset plate 108 is inserted between the first end portions 50*a* of the pair of clevis plates 50. The first end portion 50*a* of the clevis plate 50 is pin-joined to the gusset plate 108 by inserting the pin 62 through the pin hole 51 and the through-hole (not shown) formed in the gusset plate 108.

The axial force relieving step is performed after the pin joining step and before the final joining step. In the axial force relieving step, an initial compressive axial force, which is applied from the structure 100 during construction to the buckling-restrained brace 10, is relieved by adjusting the relative position between the rib plate 40 and the clevis plate 50 to freely move in the axial direction using the position adjustment mechanism while restricting the relative movement between the rib plate 40 and the clevis plate 50 in a direction other than the axial direction. Specifically, when the bolt 61 is loosened, the clevis plate 50 is in a state where it can move in parallel with respect to the rib plate 40 in the axial direction. In this state, the construction of the structure 100 progresses. Accordingly, the initial compressive axial force, which is applied from the structure 100 during construction to the buckling-restrained brace 10, can be relieved. The axial force relieving step may be performed, for example, until the construction of the structure 100 is completed. The axial force relieving step may be finished when the construction of the structure 100 has progressed to some extent.

In the final joining step, the clevis plate 50 is finally joined to the rib plate 40 by welding. The clevis plate 50 is finally joined to the core 20 by welding. Accordingly, the clevis plate 50 is firmly fixed to the rib plate 40 and the core 20.

Before the final joining step, an alignment step of adjusting an arrangement of each member of the buckling-restrained brace 10 may be performed such that the core 20 and the clevis plate 50 are aligned in the axial direction.

In the present embodiment, the method for mounting the buckling-restrained brace 10 includes the pin joining step of pin-joining the clevis plate 50 to the structure 100, and the final joining step of finally joining the clevis plate 50 to the rib plate 40, in which after the pin joining step and before the final joining step, the axial force, which is applied from the structure 100 during construction to the buckling-restrained brace 10, is relieved by adjusting the relative position between the rib plate 40 and the clevis plate 50 to freely move in the axial direction of the buckling-restrained brace 10 using the position adjustment mechanism.

Also in the present embodiment, the same effects as those in the first embodiment can be obtained. That is, since the relative position between the rib plate 40 and the clevis plate 50 can be adjusted using the position adjustment mechanism, it is possible to easily mount the buckling-restrained brace 10 on the structure 100. In addition, as the construction of the structure 100 progresses, an initial axial force is introduced into the buckling-restrained brace 10 mounted on the structure 100 due to the dead weight of the structure 100, contraction of members of the structure 100 due to a load applied to the structure 100 during construction, or the like. The axial force, which is applied from the structure 100 during construction to the buckling-restrained brace 10, can be relieved using the position adjustment mechanism such that it is possible to prevent deterioration of the seismic resistance and damping performance of the buckling-restrained brace 10.

Third Embodiment

Next, a buckling-restrained brace 10A according to a third embodiment of the present invention will be described with reference to FIGS. 7A to 7C and 8. In the present embodiment, the same components as those in the first embodiment are denoted by the same reference numerals, the description thereof will be omitted, and only the different parts will be described.

Figure 7A:
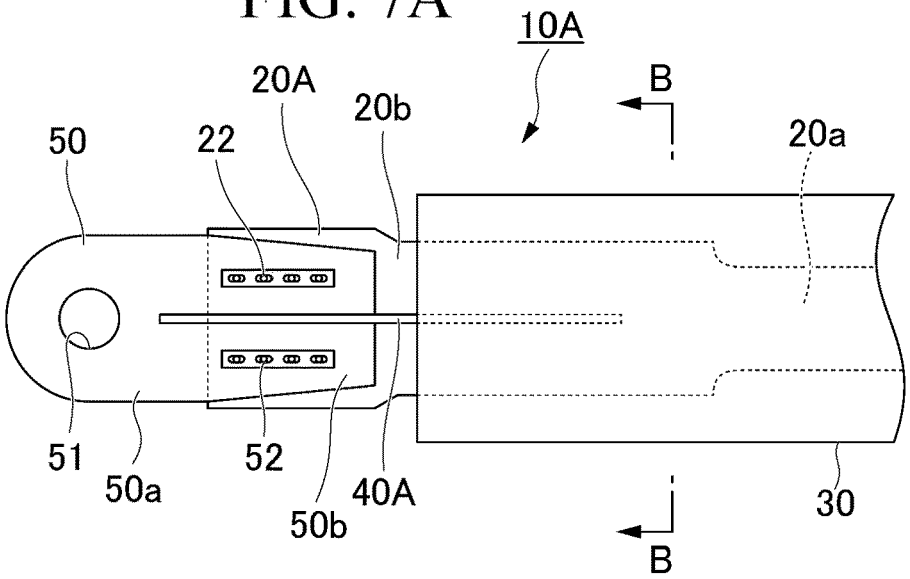
FIG. 7A is a side view showing one end portion of a buckling-restrained brace according to a third embodiment of the present invention.
Figure 7B:
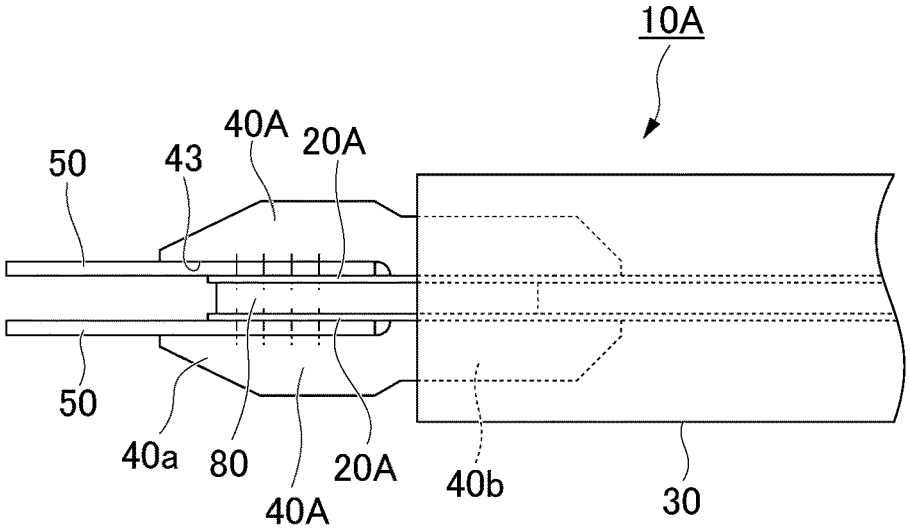
FIG. 7B is a plan view showing one end portion of the buckling-restrained brace according to the third embodiment of the present invention.
Figure 7C:
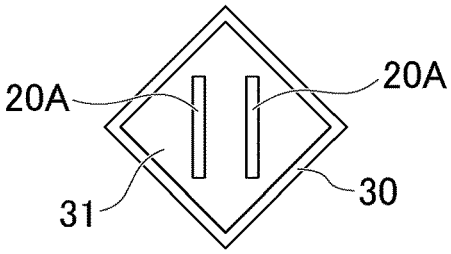
FIG. 7C is a sectional view taken along line B-B of FIG. 7A.
Figure 8:
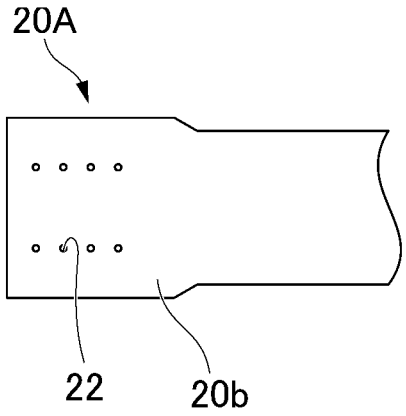
FIG. 8 is a plan view showing one end portion of a core according to the third embodiment of the present invention.

FIG. 7A is a side view showing one end portion of the buckling-restrained brace 10A, FIG. 7B is a plan view showing one end portion of the buckling-restrained brace 10A, and FIG. 7C is a sectional view taken along line B-B of FIG. 7A. FIG. 8 is a plan view showing one end portion of a core 20A.

In the present embodiment, the buckling-restrained brace 10A includes a pair of cores 20A, the restrainer 30, rib plates 40A (stiffening member), the clevis plates 50, and second interposing plates 80 (second plate).

The core 20A has a plate shape extending in the axial direction. The core 20A is formed of a steel plate. Similar to the core 20 of the first embodiment, the core 20A includes a small-width portion 20*a* and a large-width portion 20*b*. The large-width portions 20*b* are located at both ends of the core 20A in the axial direction. The width of the large-width portion 20*b* is larger than the width of the small-width portion 20*a*. The large-width portion 20*b* is shorter than the small-width portion 20*a* in the axial direction.

As shown in FIG. 8, in the present embodiment, a plurality of bolt holes 22 are formed in the large-width portion 20*b* of the core 20A. The bolt hole 22 has a circular shape. The plurality of bolt holes 22 are provided corresponding to the plurality of elongated holes 52. The plurality of bolts 61 are inserted through the plurality of bolt holes 22.

As shown in FIG. 7B, the pair of cores 20A are disposed in parallel with each other while being spaced apart from each other in the thickness direction. The second interposing plate 80 is provided between the pair of cores 20A. The second interposing plate 80 is fixed to the core 20A. For example, the second interposing plate 80 is joined to the large-width portion 20*b* of the core 20A by welding. An end portion of the second interposing plate 80 on an inside in the axial direction may be disposed inside the restrainer 30. The end portion of the second interposing plate 80 on the inside in the axial direction may be disposed outside the restrainer 30. The core 20A can be reinforced by filling a gap between the pair of cores 20A with the second interposing plate 80.

In the present embodiment, the clevis plate 50 is disposed in parallel with the core 20A. The pair of clevis plates 50 are disposed while being spaced apart from each other in the thickness direction. The pair of cores 20A are disposed in a gap between the pair of clevis plates 50. That is, the pair of cores 20A are sandwiched between the pair of clevis plates 50 in the thickness direction of the core 20A. The first end portion 50*a* of the clevis plate 50 is disposed to protrude axially outward from the core 20A. Since the second interposing plate 80 and the clevis plate 50 support the core 20A from both sides thereof in the thickness direction, the buckling strength of the core 20A can be improved.

In the present embodiment, by fastening the bolt 61 to the bolt hole 22 and the elongated hole 52, the second end portion 50*b* of the clevis plate 50 is joined to the core 20A. That is, the core 20A and the clevis plate 50 are not firmly joined and are temporarily fixed through the bolt 61. When the bolt 61 is loosened, the clevis plate 50 can move in parallel with respect to the core 20A in the axial direction and the relative position between the core 20A and the clevis plate 50 in the axial direction can be adjusted. That is, the bolt hole 22, the elongated hole 52, and the bolt 61 function as a position adjustment mechanism for adjusting the relative position between the core 20A and the clevis plate 50 in the axial direction. Accordingly, the length of the entire buckling-restrained brace 10A in the axial direction can be adjusted. The position adjustment mechanism (that is, the bolt hole 22, the elongated hole 52, and the bolt 61) is provided outside the restrainer 30.

The rib plate 40A has a plate shape extending in the axial direction. As shown in FIG. 7B, a pair of the rib plates 40A are provided at each end portion of the buckling-restrained brace 10A. The rib plate 40A has a first end portion 40*a* that is disposed axially outward and a second end portion 40*b* that is disposed axially inward than the first end portion 40*a*.

The rib plate 40A is provided to extend inside and outside the restrainer 30. The first end portion 40*a* of the rib plate 40A is disposed inside the restrainer 30, and the second end portion 40*b* of the rib plate 40A is disposed outside the restrainer 30. In the present embodiment, no bolt hole is formed in the first end portion 40*a* of the rib plate 40A.

The pair of cores 20A and the pair of clevis plates 50 are sandwiched between the pair of rib plates 40A in the thickness direction of the core 20A. The rib plate 40A is provided perpendicular to the core 20A. An angle of the rib plate 40 with respect to the core 20 may not be perpendicular. The rib plate 40 is fixed to the core 20. Specifically, the second end portion 40*b* of the rib plate 40A is joined to the large-width portion 20*b* of the core 20A by welding.

A cutout 43 corresponding to a thickness of the clevis plate 50 is formed in the first end portion 40*a* of the rib plate 40A. The second end portions 50*b* of the clevis plates 50 are disposed in the cutout 43. The pair of clevis plates 50 are sandwiched between the pair of rib plates 40A such that movement of the clevis plate 50 in the thickness direction of the core 20A is suppressed.

Next, a method for mounting the buckling-restrained brace 10A will be described. According to the present embodiment, similar to the first embodiment, the method for mounting the buckling-restrained brace 10A has a pin joining step, a position adjusting step, an axial force releasing step, and a final joining step.

In the pin joining step, the gusset plate 108 is inserted between the first end portions 50*a* of the pair of clevis plates 50. The first end portion 50*a* of the clevis plate 50 is pin-joined to the gusset plate 108 by inserting the pin 62 through the pin hole 51 and the through-hole (not shown) formed in the gusset plate 108. In the pin joining step, the relative position between the core 20A and the clevis plate 50 in the axial direction may be adjusted using the position adjustment mechanism such that the length of the entire buckling-restrained brace 10A in the axial direction is adjusted.

In the position adjusting step, the position of the clevis plate 50 is temporarily determined by adjusting the relative position between the core 20A and the clevis plate 50 in the axial direction using the position adjustment mechanism. Specifically, the bolt 61 is loosened, and the relative position between the core 20A and the clevis plate 50 in the axial direction is adjusted by moving the clevis plate 50 in parallel with respect to the core 20A in the axial direction. Thereafter, the bolt 61 is fastened again to fix the core 20A and the clevis plate 50 to each other, thereby temporarily determining the position of the clevis plate 50.

In the axial force releasing step, by using the position adjustment mechanism (specifically, by loosening the bolt 61), the temporary determination of the position of the clevis plate 50 is released, and the clevis plate 50 is moved in parallel with respect to the core 20A in the axial direction such that the initial compressive axial force, which is applied from the structure 100 to the buckling-restrained brace 10A, is released. Thereafter, the bolt 61 is fastened again to fix the core 20A and the clevis plate 50 to each other. The axial force releasing step may be performed, for example, after the construction of the structure 100 is completed. The axial force releasing step may be performed when the construction of the structure 100 has progressed to some extent.

In the final joining step, the clevis plate 50 is finally joined to the core 20A by welding. The clevis plate 50 is finally joined to the rib plate 40A by welding. Accordingly, the clevis plate 50 is firmly fixed to the core 20A and the rib plate 40A.

In the present embodiment, the mounting method according to the second embodiment may be adopted. In this case, the method for mounting the buckling-restrained brace 10A has a pin joining step, an axial force relieving step, and a final joining step. Since the pin joining step and the final joining step are the same as described above, the description thereof will be omitted herein.

The axial force relieving step is performed after the pin joining step and before the final joining step. In the axial force relieving step, an initial compressive axial force, which is applied from the structure 100 during construction to the buckling-restrained brace 10A, is relieved by adjusting the relative position between the core 20A and the clevis plate 50 to freely move in the axial direction using the position adjustment mechanism while restricting the relative movement between the core 20A and the clevis plate 50 in a direction other than the axial direction. Specifically, when the bolt 61 is loosened, the clevis plate 50 is in a state where it can move in parallel with respect to the core 20A in the axial direction. In this state, the construction of the structure 100 progresses. Accordingly, the initial compressive axial force, which is applied from the structure 100 during construction to the buckling-restrained brace 10A, can be relieved. The axial force relieving step may be performed, for example, until the construction of the structure 100 is completed. The axial force relieving step may be finished when the construction of the structure 100 has progressed to some extent.

In the present embodiment, the buckling-restrained brace 10A includes the core 20A, the restrainer 30 encasing the core 20A from an outer side thereof, the rib plate 40A joined to the core 20A in a state where a part of the rib plate 40A is disposed inside the restrainer 30, and the clevis plate 50 having the first end portion 50*a* that is pin-joined to the structure 100 and the second end portion 50*b* that is joined to the core 20A. The elongated hole 52 is provided in the clevis plate 50 as the position adjustment mechanism configured to adjust the relative position between the core 20A and the clevis plate 50.

Also in the present embodiment, the same effects as those in the first embodiment can be obtained. That is, since the relative position between the core 20A and the clevis plate 50 can be adjusted using the position adjustment mechanism, it is possible to easily mount the buckling-restrained brace 10A on the structure 100. In addition, as the construction of the structure 100 progresses, an initial axial force is introduced into the buckling-restrained brace 10A mounted on the structure 100 due to the dead weight of the structure 100, contraction of members of the structure 100 due to a load applied to the structure 100 during construction, or the like. The relative position between the core 20A and the clevis plate 50 is adjusted using the position adjustment mechanism such that it is possible to release the axial force applied from the structure 100 to the buckling-restrained brace 10A. Therefore, it is possible to prevent deterioration of the seismic resistance and damping performance of the buckling-restrained brace 10A.

In addition, since the elongated hole 52 is provided as the position adjustment mechanism, it is possible to easily adjust the relative position between the core 20A and the clevis plate 50 with a simple configuration.

Further, the buckling-restrained brace 10A has the pair of cores 20A provided to be spaced apart from each other in the thickness direction of the core 20A.

Accordingly, a cross sectional area of the cores 20A can be increased as compared with the buckling-restrained brace 10 having one core 20, and thus a yielding strength of the core 20A is improved.

In addition, the buckling-restrained brace 10A further includes the second interposing plate 80 provided between the pair of cores 20A.

Since the core 20A can be reinforced by the second interposing plate 80, the buckling strength of the buckling-restrained brace 10A is further improved, and the seismic resistance and damping performance of the buckling-restrained brace 10A are further improved.

Fourth Embodiment

Next, a buckling-restrained brace 10B according to a fourth embodiment of the present invention will be described with reference to FIGS. 9A to 9C. In the present embodiment, the same components as those in the third embodiment are denoted by the same reference numerals, the description thereof will be omitted, and only the different parts will be described.

Figure 9A:
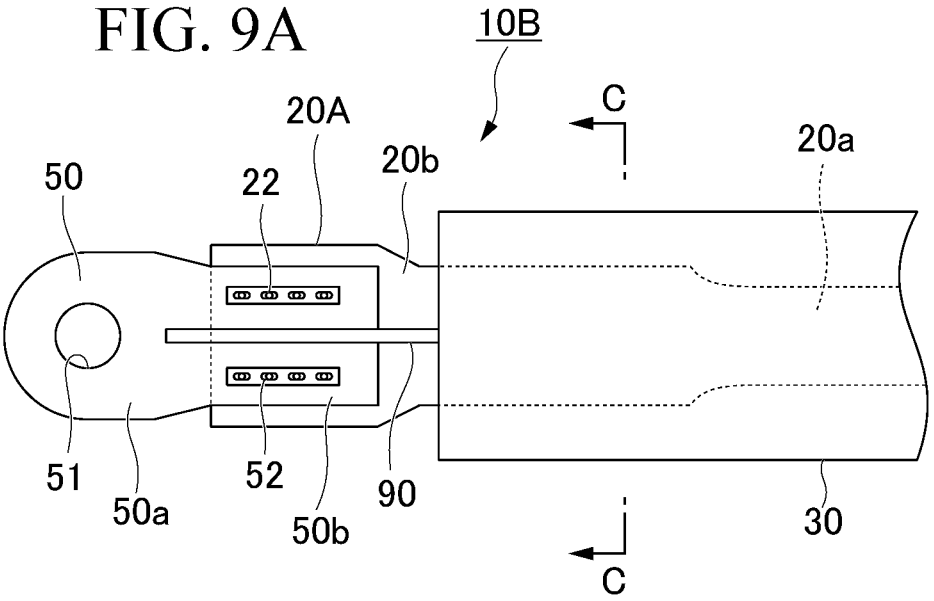
FIG. 9A is a side view showing one end portion of a buckling-restrained brace according to a fourth embodiment of the present invention.
Figure 9B:
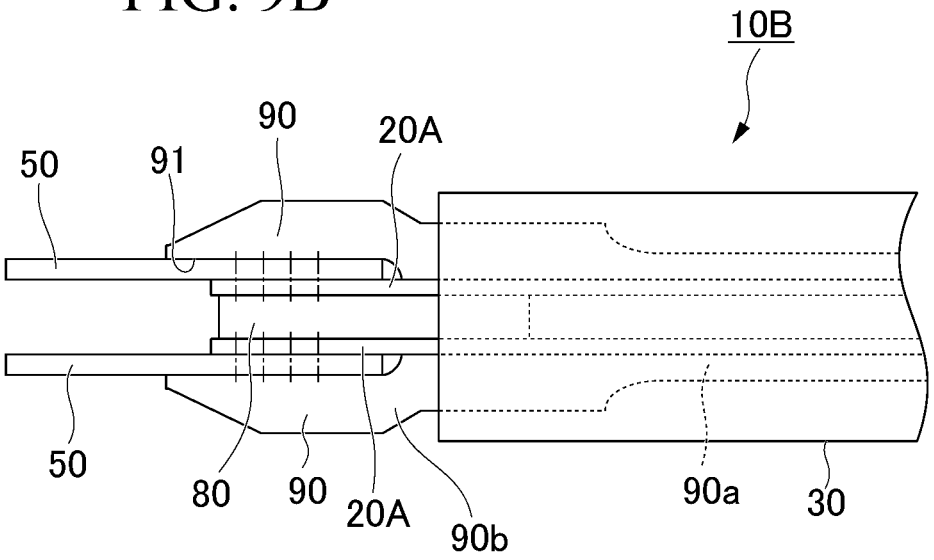
FIG. 9B is a plan view showing one end portion of the buckling-restrained brace according to the fourth embodiment of the present invention.
Figure 9C:
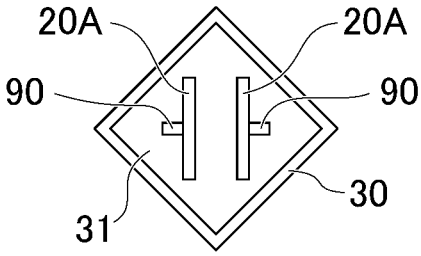
FIG. 9C is a sectional view taken along line C-C of FIG. 9A.

FIG. 9A is a side view showing one end portion of the buckling-restrained brace 10B, FIG. 9B is a plan view showing one end portion of the buckling-restrained brace 10B, and FIG. 9C is a sectional view taken along line C-C of FIG. 9A.

In the present embodiment, the buckling-restrained brace 10B includes the pair of cores 20A, a pair of second cores 90 as stiffening members, the restrainer 30, the clevis plates 50 (connector), and the second interposing plates 80 (second plate). That is, the present embodiment is different from the third embodiment in that the second core 90 is provided instead of the rib plate 40A.

The second core 90 has a plate shape extending in the axial direction. The second core 90 includes a small-width portion 90*a* and large-width portions 90*b*. The small-width portion 90*a* is located at a center of the second core 90 in the axial direction. The large-width portions 90*b* are located at both ends of the second core 90 in the axial direction. The width of the large-width portion 90*b* is larger than the width of the small-width portion 90*a*. The length of the large-width portion 90*b* in the axial direction is shorter than the length of the small-width portion 90*a* in the axial direction. Since the center of the second core 90 in the axial direction is the small-width portion 90*a* and the end portions of the second core 90 in the axial direction are the large-width portions 90*b*, the center of the second core 90 in the axial direction (small-width portion 90*a*) is a region that is easily plasticized, and the plasticized region is limited to the center of the second core 90 in the axial direction.

The length of the restrainer 30 in the axial direction is shorter than the length of the entire second core 90 in the axial direction. The length of the restrainer 30 in the axial direction is longer than the length of the small-width portion 90*a* of the second core 90 in the axial direction. Therefore, the large-width portion 90*b* of the second core 90 protrudes outward from the restrainer 30 in the axial direction.

The pair of cores 20A are sandwiched between the pair of second cores 90 in the thickness direction of the core 20A. The second core 90 is provided perpendicular to the core 20A. The second core 90 is disposed at the center of the core 20A in the width direction. As shown in FIG. 9C, a cross-sectional shape of the core 20A and the second core 90 orthogonal to the axial direction has a T shape. A portion, excluding a cutout 91 which will be described later, of an edge of the second core 90 on an inside in the width direction abuts the core 20A. The second core 90 is fixed to the core 20A. For example, the portion, excluding the cutout 91, of the edge of the second core 90 on the inside in the width direction is joined to the core 20A by welding. With the pair of second cores 90, a yielding strength of the core 20A can be improved.

The cutout 91 corresponding to a thickness of the clevis plate 50 is formed in the end portion of the second core 90 in the axial direction. The second end portion 50*b* of the clevis plate 50 is disposed in the cutout 91. Therefore, in addition to the pair of cores 20A, the second end portions 50*b* of the pair of clevis plates 50 are sandwiched between the end portions of the pair of second cores 90 in the axial direction. The pair of clevis plates 50 are sandwiched between the pair of second cores 90 such that movement of the clevis plate 50 in the thickness direction of the core 20A is suppressed.

In the present embodiment, similar to the third embodiment, the bolt hole 22, the elongated hole 52, and the bolt 61 function as a position adjustment mechanism for adjusting the relative position between the core 20A and the clevis plate 50 in the axial direction. Accordingly, the length of the entire buckling-restrained brace 10B in the axial direction can be adjusted. The position adjustment mechanism (that is, the bolt hole 22, the elongated hole 52, and the bolt 61) is provided outside the restrainer 30.

Next, a method for mounting the buckling-restrained brace 10B will be described. According to the present embodiment, similar to the first embodiment, the method for mounting the buckling-restrained brace 10B has a pin joining step, a position adjusting step, an axial force releasing step, and a final joining step.

In the pin joining step, the gusset plate 108 is inserted between the first end portions 50*a* of the pair of clevis plates 50. The first end portion 50*a* of the clevis plate 50 is pin-joined to the gusset plate 108 by inserting the pin 62 through the pin hole 51 and the through-hole (not shown) formed in the gusset plate 108. In the pin joining step, the relative position between the core 20A and the clevis plate 50 in the axial direction may be adjusted using the position adjustment mechanism such that the length of the entire buckling-restrained brace 10B in the axial direction is adjusted.

In the position adjusting step, the position of the clevis plate 50 is temporarily determined by adjusting the relative position between the core 20A and the clevis plate 50 in the axial direction using the position adjustment mechanism. Specifically, the bolt 61 is loosened, and the relative position between the core 20A and the clevis plate 50 in the axial direction is adjusted by moving the clevis plate 50 in parallel with respect to the core 20A in the axial direction. Thereafter, the bolt 61 is fastened again to fix the core 20A and the clevis plate 50 to each other, thereby temporarily determining the position of the clevis plate 50.

In the axial force releasing step, by using the position adjustment mechanism (specifically, by loosening the bolt 61), the temporary determination of the position of the clevis plate 50 is released, and the clevis plate 50 is moved in parallel with respect to the core 20A in the axial direction such that the initial compressive axial force, which is applied from the structure 100 to the buckling-restrained brace 10B, is released. Thereafter, the bolt 61 is fastened again to fix the core 20A and the clevis plate 50 to each other. The axial force releasing step may be performed, for example, after the construction of the structure 100 is completed. The axial force releasing step may be performed when the construction of the structure 100 has progressed to some extent.

In the final joining step, the clevis plate 50 is finally joined to the core 20A by welding. The clevis plate 50 is finally joined to the second core 90 by welding. Accordingly, the clevis plate 50 is firmly fixed to the core 20A and the second core 90.

In the present embodiment, the mounting method according to the second embodiment may be adopted. In this case, the method for mounting the buckling-restrained brace 10B has a pin joining step, an axial force relieving step, and a final joining step. Since the pin joining step and the final joining step are the same as described above, the description thereof will be omitted herein.

The axial force relieving step is performed after the pin joining step and before the final joining step. In the axial force relieving step, an initial compressive axial force, which is applied from the structure 100 during construction to the buckling-restrained brace 10B, is relieved by adjusting the relative position between the core 20A and the clevis plate 50 to freely move in the axial direction using the position adjustment mechanism while restricting the relative movement between the core 20A and the clevis plate 50 in a direction other than the axial direction. Specifically, when the bolt 61 is loosened, the clevis plate 50 is in a state where it can move in parallel with respect to the core 20A in the axial direction. In this state, the construction of the structure 100 progresses. Accordingly, the initial compressive axial force, which is applied from the structure 100 during construction to the buckling-restrained brace 10B, can be relieved. The axial force relieving step may be performed, for example, until the construction of the structure 100 is completed. The axial force relieving step may be finished when the construction of the structure 100 has progressed to some extent.

Also in the present embodiment, the same effects as those in the first embodiment can be obtained. That is, since the relative position between the core 20A and the clevis plate 50 can be adjusted using the position adjustment mechanism, it is possible to easily mount the buckling-restrained brace 10B on the structure 100. In addition, as the construction of the structure 100 progresses, an initial axial force is introduced into the buckling-restrained brace 10B mounted on the structure 100 due to the dead weight of the structure 100, contraction of members of the structure 100 due to a load applied to the structure 100 during construction, or the like. The relative position between the core 20A and the clevis plate 50 is adjusted using the position adjustment mechanism such that it is possible to release the axial force applied from the structure 100 to the buckling-restrained brace 10B. Therefore, it is possible to prevent deterioration of the seismic resistance and damping performance of the buckling-restrained brace 10B.

In addition, since the elongated hole 52 is provided as the position adjustment mechanism, it is possible to easily adjust the relative position between the core 20A and the clevis plate 50 with a simple configuration.

Further, the buckling-restrained brace 10B has the pair of second cores 90, and the core 20A is sandwiched between the pair of second cores 90 in the thickness direction of the core 20A.

Since the pair of second cores 90 are provided in addition to the core 20A, the yielding strength of the core 20A is further improved as compared with the buckling-restrained braces 10 and 10A.

The present invention is not limited to the above-described embodiments described with reference to the drawings, and various modified examples are considered within the technical scope thereof.

In the above-described embodiments, the elongated hole 52 as the position adjustment mechanism is formed in the clevis plate 50, but the present invention is not limited thereto.

Figure 10:
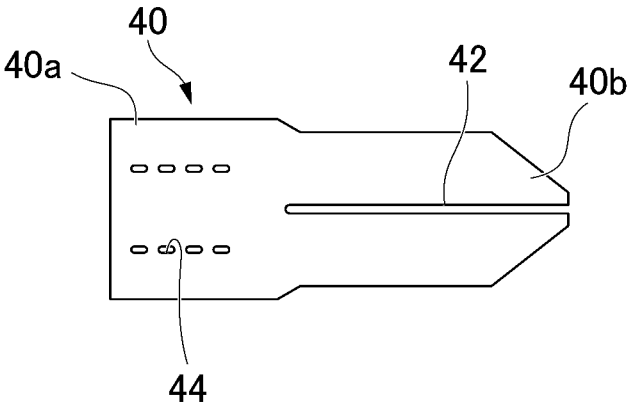
FIG. 10 is a plan view of a clevis plate according to a modified example of the first embodiment of the present invention.

For example, in the first embodiment, the elongated hole may be provided in at least one of the rib plate 40 and the clevis plate 50. For example, as shown in FIG. 10, an elongated hole 44 is formed in the rib plate 40 instead of the bolt hole 41, and a bolt hole may be formed in the clevis plate 50. An elongated hole may be formed in both the rib plate 40 and the clevis plate 50.

Figure 11:
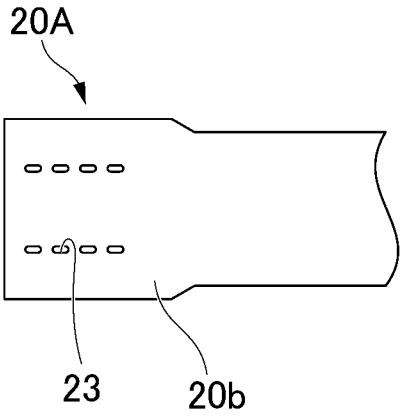
FIG. 11 is a plan view showing one end portion of a core according to a modified example of the third embodiment and the fourth embodiment of the present invention.

In the third embodiment and the fourth embodiment, an elongated hole may be provided in at least one of the core 20A and the clevis plate 50. For example, as shown in FIG. 11, an elongated hole 23 may be formed in the core 20A instead of the bolt hole 22, and the bolt hole may be formed in the clevis plate 50. An elongated hole may be formed in both the core 20A and the clevis plate 50.

In the above-described embodiment, a steel pipe is used as the restrainer 30, but the present invention is not limited thereto. The restrainer 30 may be made of wood. In this case, for example, the wooden restrainer 30 is formed of a pair of restraining materials, and the restraining materials come into direct contact with the core 20. Therefore, an infill material is not filled inside the restrainer 30. The pair of restraining materials restrict the displacement of the core 20 in the thickness direction. In addition, a regulating member is provided between the pair of the restraining materials, and the regulating member restricts the displacement of the core 20 in the width direction. Accordingly, the deformation of the core 20 in a direction other than the axial direction is restricted.

In the first embodiment, the first interposing plate 70 may be omitted. In the third embodiment and the fourth embodiment, the second interposing plate 80 may be omitted.

The shapes, arrangements, and quantities of the cores 20 and 20A and the second core 90 are not limited to the above-described embodiments. For example, in the first embodiment, the pair of second cores 90 may be provided to sandwich a single core 20 therebetween in the thickness direction. In the first embodiment, a pair of the cores 20, which are disposed while being spaced apart from each other in the thickness direction, may be provided. In the third embodiment and the fourth embodiment, the two second cores 90 may be provided for one core 20A. In this case, for example, the two second cores 90 may be disposed at both ends of the core 20A in the width direction. In the first to fourth embodiments, three or more cores 20 and 20A may be provided.

In addition, it is possible to appropriately replace the components in the above-described embodiments with well-known components without departing from the gist of the present invention, and the modified examples described above may be combined as appropriate.

INDUSTRIAL APPLICABILITY

The present invention can be applied to a buckling-restrained brace and a method for mounting a buckling-restrained brace.

REFERENCE SIGNS LIST

10, 10A, 10B: Buckling-restrained brace
20, 20A: Core
30: Restrainer
40, 40A: Rib plate (stiffening member)
50: Clevis plate (connector)
52: Elongated hole
61: Bolt
62: Pin

70: First interposing plate (first plate)
80: Second interposing plate (second plate)
90: Second core (stiffening member)

The invention claimed is:

1. A buckling-restrained brace to be mounted on a structure, the buckling-restrained brace comprising:
a core;
a restrainer encasing the core from an outer side thereof;
a stiffening member joined to the core in a state where a part of the stiffening member is disposed inside the restrainer; and
a connector having a first end portion that is pin-joined to the structure and a second end portion that is joined to at least one of the core and the stiffening member,
wherein an elongated hole is provided in at least one of the core, the stiffening member, and the connector as a position adjustment mechanism configured to adjust a relative position between the connector and at least one of the core and the stiffening member.

2. The buckling-restrained brace according to claim 1, wherein the elongated hole is provided in the connector.

3. The buckling-restrained brace according to claim 1, wherein the elongated hole is provided in the core or the stiffening member.

4. The buckling-restrained brace according to claim 1, wherein as the connector, a pair of connectors are provided, and the core or the stiffening member is sandwiched between the pair of connectors.

5. The buckling-restrained brace according to claim 1, wherein as the stiffening member, a pair of stiffening members are provided to be spaced apart from each other in a width direction of the core.

6. The buckling-restrained brace according to claim 5, further comprising
a first plate provided between the pair of stiffening members.

7. The buckling-restrained brace according to claim 1, wherein as the core, a pair of cores are provided to be spaced apart from each other in a thickness direction of the core.

8. The buckling-restrained brace according to claim 7, further comprising
a second plate provided between the pair of cores.

9. The buckling-restrained brace according to claim 1, wherein
the stiffening member includes a pair of second cores, and
the core is located between the pair of second cores in a thickness direction of the core.

10. The buckling-restrained brace according to claim 1, wherein the restrainer has a tubular shape,
an inside of the restrainer is filled with an infill material, and
the elongated hole is provided outside the restrainer.

11. A method for mounting a buckling-restrained brace on a structure, the buckling-restrained brace including:
a core;
a restrainer encasing the core from an outer side thereof;
a stiffening member joined to the core in a state where a part of the stiffening member is disposed inside the restrainer; and
a connector having a first end portion that is pin-joined to the structure and a second end portion that is joined to at least one of the core and the stiffening member,
wherein an elongated hole is provided in at least one of the core, the stiffening member, and the connector as a position adjustment mechanism configured to adjust a relative position between the connector and at least one of the core and the stiffening member,
the method comprising:
a position adjusting step of temporarily determining a position of the connector by adjusting a relative position between the connector and at least one of the core and the stiffening member using the position adjustment mechanism;
an axial force releasing step of releasing an axial force applied from the structure to the buckling-restrained brace by releasing the temporary determination of the position of the connector using the position adjustment mechanism; and
a final joining step of finally joining the connector to at least one of the core and the stiffening member, the final joining step being performed after the axial force releasing step.

12. The method for mounting the buckling-restrained brace according to claim 11, further comprising
a pin joining step of pin-joining the connector to the structure, the pin joining step being performed before the position adjusting step.

13. A method for mounting a buckling-restrained brace on a structure, the buckling-restrained brace including:
a core;
a restrainer encasing the core from an outer side thereof;
a stiffening member joined to the core in a state where a part of the stiffening member is disposed inside the restrainer; and
a connector having a first end portion that is pin-joined to the structure and a second end portion that is joined to at least one of the core and the stiffening member,
wherein an elongated hole is provided in at least one of the core, the stiffening member, and the connector as a position adjustment mechanism configured to adjust a relative position between the connector and at least one of the core and the stiffening member,
the method comprising:
a pin joining step of pin-joining the connector to the structure; and
a final joining step of finally joining the connector to at least one of the core and the stiffening member,
wherein after the pin joining step and before the final joining step, an axial force, which is applied from the structure during construction to the buckling-restrained brace, is relieved by adjusting a relative position between the connector and at least one of the core and the stiffening member to freely move in an axial direction of the buckling-restrained brace using the position adjustment mechanism.

* * * * *